US005971795A

United States Patent [19]

Daoud et al.

[11] Patent Number: 5,971,795

[45] Date of Patent: Oct. 26, 1999

[54] MULTIPLE LEVEL NETWORK INTERFACE DEVICE

[75] Inventors: Bassel H. Daoud, Parsippany; Christopher M. Helmstetter, Bridgewater, both of N.J.

[73] Assignee: Lucent Technologies, Inc., Murray Hill, N.J.

[21] Appl. No.: 09/107,674

[22] Filed: Jun. 30, 1998

[51] Int. Cl.[6] ..... H01R 4/24

[52] U.S. Cl. ..... 439/409; 379/399

[58] Field of Search ..... 439/409, 410, 439/417, 412, 413; 379/399, 438, 332

[56] References Cited

U.S. PATENT DOCUMENTS

| | | | |
|---|---|---|---|
| 4,396,809 | 8/1983 | Brunssen | 179/175 |
| 4,913,659 | 4/1990 | Doyle | 439/395 |
| 5,004,433 | 4/1991 | Daoud | 439/502 |
| 5,222,908 | 6/1993 | Baker, III et al. | 439/557 |
| 5,240,432 | 8/1993 | Daoud | 439/417 |
| 5,562,478 | 10/1996 | Yamamoto | 439/417 |
| 5,681,182 | 10/1997 | Reichle | 439/417 |
| 5,721,396 | 2/1998 | Daoud | 174/59 |
| 5,740,685 | 4/1998 | Daoud | 70/164 |

OTHER PUBLICATIONS

Egerton, Advertisement entitled "Mini–Rocker Cross Connect".

*Primary Examiner*—Neil Abrams
*Assistant Examiner*—Javad Nasri
*Attorney, Agent, or Firm*—Duane Morris & Heckscher LLP; Steven E. Koffs

[57] ABSTRACT

A network interface device has a base. The base has a first jack on its bottom and a second jack on its top. A middle section is pivotally attached to the base. The middle section has a plug portion shaped to fit into the second jack. The plug portion has first and second terminals. Each terminal has an upper portion and a lower portion. The lower portions of the first and second terminals are connected to the first jack by a pair of openings in the base between the first and second jacks. Each of the openings is capable of receiving a conducting portion of an external plug when the external plug is inserted in the first jack, so that the conducting portions of the external plug contact the lower portions of the first and second terminals. An upper section is pivotally attached to the middle section. The upper section receives the upper portions of the first and second terminals. The upper section has first and second holes. The upper section has an open position for insertion of first and second wires into the first and second holes, respectively, and a closed position for connecting the upper portions of the first and second terminals to the respective first and second wires.

23 Claims, 7 Drawing Sheets

MULTIPLE LEVEL NETWORK INTERFACE DEVICE

FIELD OF THE INVENTION

The present invention relates to network interfaces for telecommunications equipment.

DESCRIPTION OF THE RELATED ART

Most modern multi-occupant buildings have a network interface unit, which includes a plurality of customer bridges. Each customer bridge provides an interface between the external telephone network lines and the internal lines of an individual customer. An example of a bridge assembly is described in U.S. Pat. No. 5,222,908 to Baker, III et al., which is incorporated by reference herein in its entirety.

The bridge typically includes a standard RJ11 jack which provides a test point for testing continuity at the entrance to the customer premises. A standard telephone may be plugged into the RJ11 jack for test purposes; if a normal dial tone is provided, then there is continuity in the circuits outside of the customer's premises. In normal operation, however, the jack is attached to an output wire connector through an RJ11 plug/cord assembly such as the assemblies described in U.S. Pat Nos. 5,004,433 and 5,240,432 to Daoud, both of which are also incorporated by reference herein in their entireties. The customer's telephones, PBX equipment, etc. all are in turn connected through the output wire connector.

An improved customer bridge system is desired.

SUMMARY OF THE INVENTION

The present invention is a network interface device (NID), in which the RJ11 plug/cord assembly and output connector are replaced by an integrated plug/output connector structure. The bottom portion of each output connector terminal provides the function of the contact points of the RJ11 plug.

The NID, has a base, a middle section and an upper section. The base has a first jack on its bottom and a second jack on its top. The middle section has a plug portion shaped to fit into the second jack. The plug portion has first and second terminals. Each terminal has an upper portion and a lower portion. The lower portions of the first and second terminals are connected to the first jack. The upper section receives the upper portions of the first and second terminals. The upper section includes first and second holes. The upper section has an open position for insertion of first and second wires into the first and second holes, respectively, and a closed position for connecting the upper portions of the first and second terminals to the respective first and second wires.

According to a further aspect of the invention, a connector includes a body having a plug portion shaped to fit into a telephone jack. Two terminals extend through the plug portion. Each terminal has an upper portion and a lower portion. The lower portions of the terminals are electrically connected to the telephone jack when the plug portion is inserted in the telephone jack. An upper section is pivotally attached to the body. The upper section receives the upper portions of the terminals. The upper section includes two holes. The upper section has an open position for insertion of wires into the two holes, and a closed position for connecting the upper portions of the terminals to the wires.

DETAILED DESCRIPTION

Figure 1B:
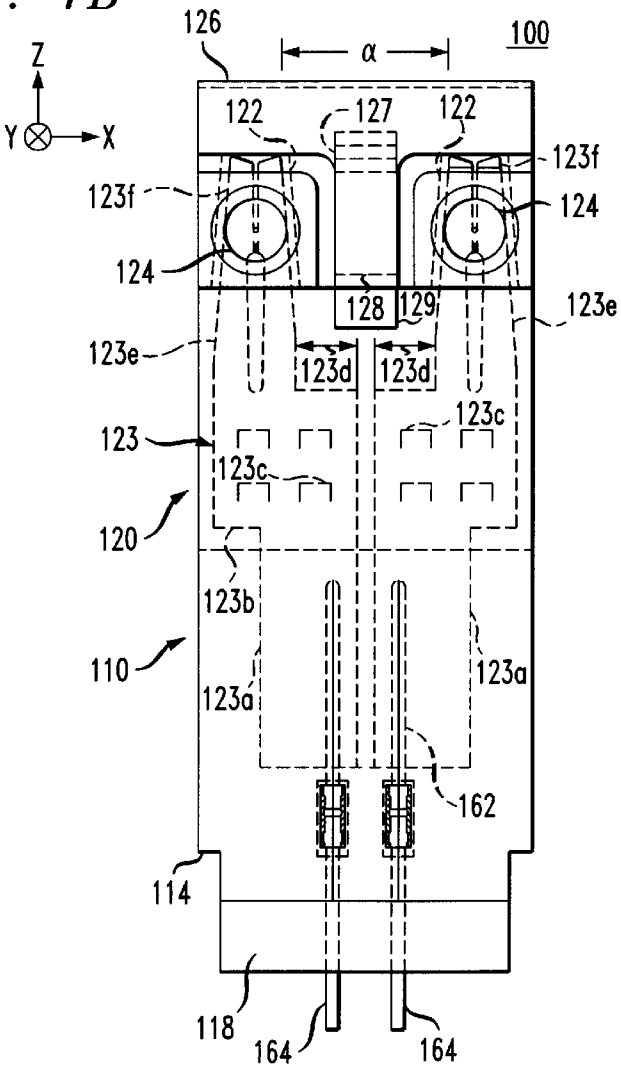
FIG. 1B is a side elevation view of the device of FIG. 1A.

FIGS. 1A–1G show an exemplary embodiment of the present invention. The present invention is a bridge assembly 100, incorporating an external network interface 110 and a customer output wire connector 120 in a compact, multiple-level unit.

Advantageously, the bridge assembly 100 has the customer output connector 120 positioned directly on top of the network interface portion 110, without connecting wires or cables. When the plug portion 152 is inserted in the second jack 153, and the upper section 126 is in the closed position, the total footprint of the assembly 100 is approximately the sum of the footprints of the first jack 161 and the second jack 153. This construction reduces the footprint of the customer bridge assembly 100 well below that of prior art devices.

A second advantage of the device is that it is integrally formed, either from a single piece of material, or from three pieces connected by two hinges or pivots 170 and 172. There are no loose parts that might easily separate from the assembly 100 during installation or maintenance.

A third advantage of the device is that installation is very quick and simple. As described in greater detail below, the bridge assembly 100 snaps into place in a network interface unit panel (not shown). The external network plug 160 is inserted into the external network jack 161. Customer lead wires (not shown) are inserted into an insulation displacement type connector 120, and two portions 126 and 130 of the assembly 100 are pivoted about hinge joints 172 and 170, respectively, to complete the installation.

FIGS. 1A–1D show the assembly 100. The external network interface 110 has a base 112 and a top portion 130. The base 112 has a first jack 161 and a second jack 153 which are electrically connected to each other. The first jack 161 may be a standard type-645 jack from the external network. The first jack 161 may be on the bottom of the base 112. The second jack 153 may be a standard RJ11 jack for a telephone, and may be positioned on the top of the base 112. The first jack 161 and second jack 153 are positioned so that an electrical connection is formed between a plug 160 in the first jack and a plug 152 in the second jack.

The base has a fastening mechanism, which may be, for example, a simple latching mechanism 158, 118. A shoulder 114 provides a bearing surface, so the base 112 can be secured to a rectangular opening in a panel, with the outer edge of the opening gripped between the shoulder 114 and the latch 158.

A middle section 121, 130 is pivotally attached to the base. The middle section of assembly 100 includes the body 121 of an insulation displacement connector (IDC) 120, and the top portion 130 of the external network interface 110. In the exemplary embodiment, the body 121 and top portion 130 are formed as a single, continuous unit. The top portion 130 of the external network interface 110 has a plug portion 152 shaped to fit into the second jack 153. The plug portion 152 has first and second slots 125, into which respective first and second terminals 123 fit.

Each terminal 123 has an upper portion 123*e* and a lower portion 123*a*. The lower portion 123*a* extends through the plug portion 152, and terminates in a shape like the conductor of an RJ11 plug. This configuration enables the terminals 123 to form an electrical connection to the conductors 162 of the type-645 plug 160, when the plug portion 152 is insert RJ11 jack 153. A middle portion 123*b* of each terminal 123*a* has a plurality of barbs 123*c* for gripping the surface of slot 125. The upper section 123*e* of each terminal 123 may be offset from the lower section 123*a* of the terminal by an offset distance 123*d*. Each upper section 123*e* has means of displacing insulation from a lead wire (not shown), which may be a pair of upwardly projecting tangs 123*f*.

The exemplary terminals 123 may be secured in the plug portion 152 using an ultra-sonic tool. One of ordinary skill in the art recognizes that terminals 123 may have a variety of alternative gripping surfaces in place of the barbs 123*c*, such as grooves, lands, knurled surface, etc. Alternatively, the terminals 123 may be secured by an adhesive, which may be an epoxy.

The lower portions 123*a* of the first and second terminals 123 are connected to the first jack 161 by a pair of openings 166 (FIG. 1D) in the base 112, connecting the jacks 153 and 161. Each of the openings 166 is capable of receiving a conducting portion 162 of the external type-645 plug 160 when the external plug 160 is inserted in the first jack 161, so that the conducting portions 162 of the external plug 160 contact the lower portions 123*a* of the first and second terminals 123.

An upper section 126 is pivotally attached to the middle section 121, 130. Upper section 126 is the cap of the IDC connector 120. The upper section 126 receives the upper portions 123*e* and 123*f* of the first and second terminals 123. The upper section 126 includes first and second holes 124. The upper section 126 has an open position (FIG. 1F) for insertion of first and second customer lead wires (not shown) into the first and second holes 124, respectively, and a closed position (FIG. 1E) for connecting the upper portions 123*e* of the first and second terminals 123 to the respective first and second customer lead wires.

Preferably, the assembly 100 includes a pair of hinges. A first hinge 170 attaches the middle section 130 to the base 112. A second hinge 172 attaches the upper portion 126 of the assembly 100 to the bottom portion 121 of connector 120. Further, each hinge 170 and 172 may be a living hinge. If hinges 170 and 172 are living hinges, the base 112, middle section 121 and 130, and the upper section 126 may be integrally formed by a single piece of an insulating material. Exemplary materials are polypropylene and polycarbonate. Other polymers and insulators may also be used.

A bridge assembly according to the invention may be installed very quickly, because of the elimination of connecting wires. No wires need to be measured or cut during installation.

To install the device, the base 112 of the assembly 100 snaps into a rectangular opening in the panel of a network interface unit (not shown). The connection to the external telephone network is made by inserting the plug 160 into jack 161. If the upper portion 126 of the connector 120 is in the position shown in FIG. 1G, the upper portion 126 is pivoted to the "open" position shown in FIG. 1F. The customer lead wires (not shown) are inserted into the lead wire receiving holes 124 of the customer output connector 120. The upper portion 126 is pivoted about hinge 172 and pushed down onto the bottom portion 121 of connector 120 (the position shown in FIG. 1E), to connect the customer lead wires to the terminals 123 in the plug portion 152. The middle and top portions 130, 121, and 126 are pivoted together as a unit, about the hinge 170, until the plug portion 152 enters RJ11 jack 153, connecting the customer's internal lines to the external network lines.

According to an aspect of the present invention, a latching means is positioned only between the first and second holes 124, for maintaining the upper portion 126 of the connector 120 in the closed position. In the exemplary embodiment, the latching means is a single latch 129. One of ordinary skill recognizes that, alternatively, multiple latches positioned between the holes 124 could also be used, possibly resulting in an increase in the width of the connector 120. Further, the phrase, "only between the first and second holes" is expressly defined herein to mean that, in the horizontal (X) direction shown in FIG. 1B, the latching means 129 lies within the horizontal range $\alpha$. The phrase "only between the first and second holes" is not intended to restrict the position of the latching means in the vertical (Z) direction of FIG. 1B.

Because the latch 129 is between the holes 124, it is possible to position the upper portions 123*e* and cutting tangs 123*f* of terminals 123 further apart in the horizontal (X) direction of FIG. 1B. It is desirable to separate terminals 123 for at least two reasons: (1) increasing the space between terminals 123 reduces parasitic (i.e., capacitive or inductive) couplings between the two terminals; and (2) given a desired minimum distance between the two terminals 123, (and assuming no separation in the vertical (Z) direction of FIG. 1) increasing the separation in the (X) direction reduces the amount of separation in the (Y) direction necessary to provide the desired total separation.

Figure 1A:
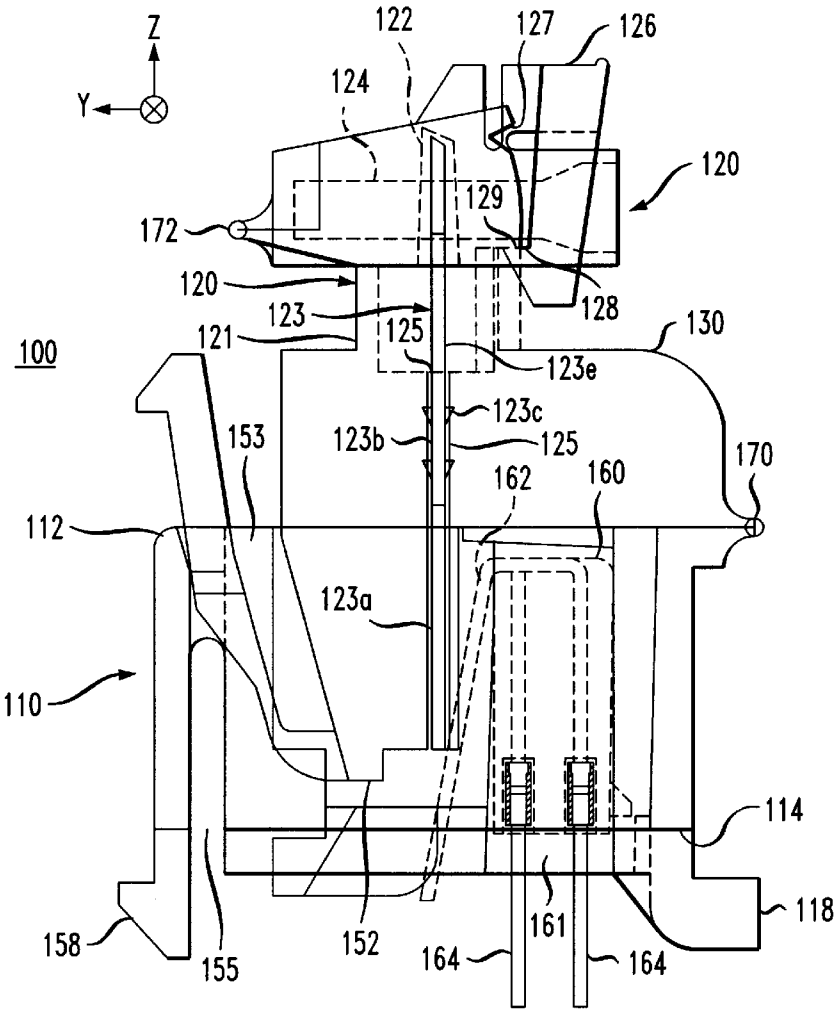
FIG. 1A is a front elevation view of an exemplary embodiment of the present invention.
Figure 1C:
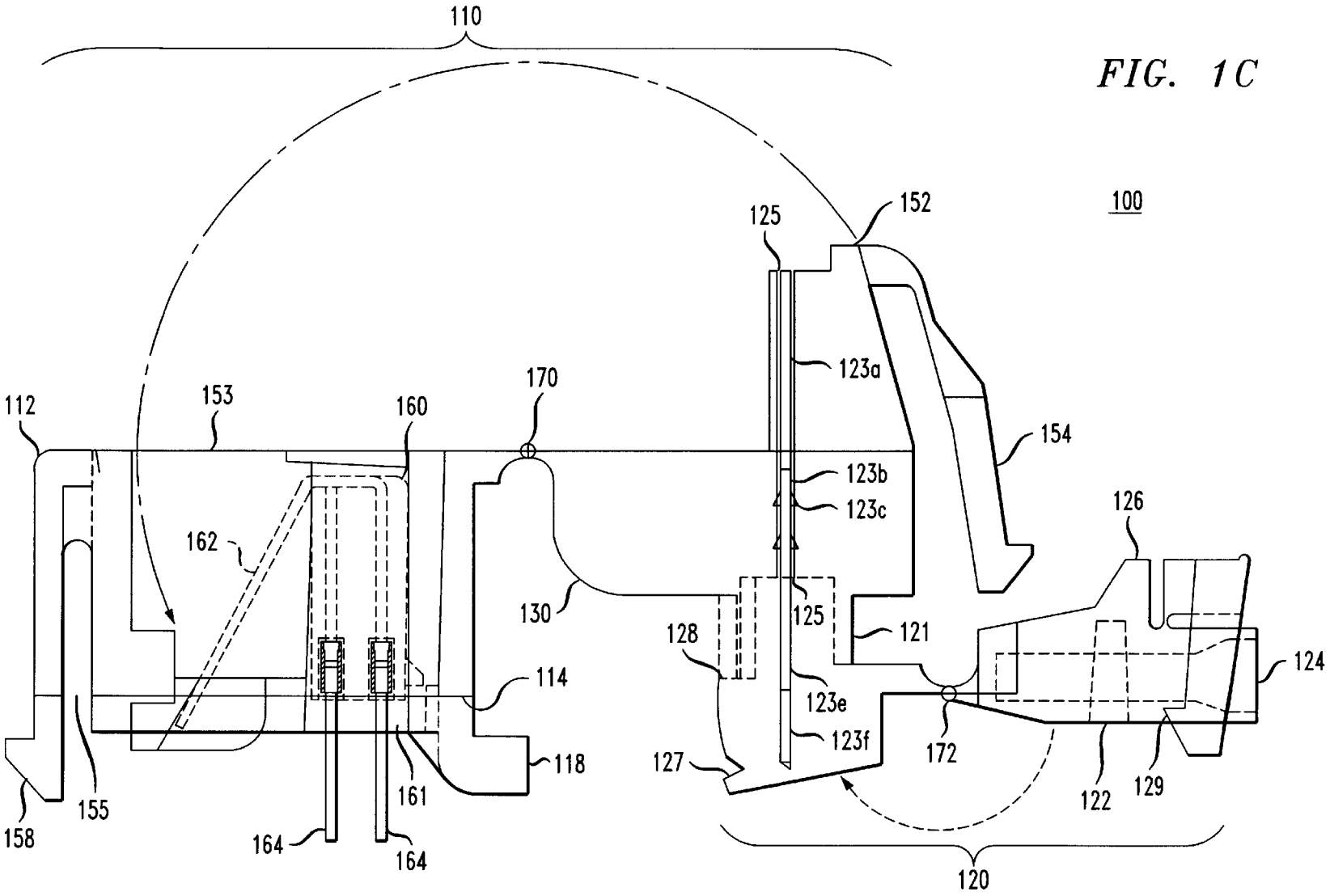
FIG. 1C is a front elevation view of the device of FIG. 1A, with both hinges fully opened.
Figure 1D:
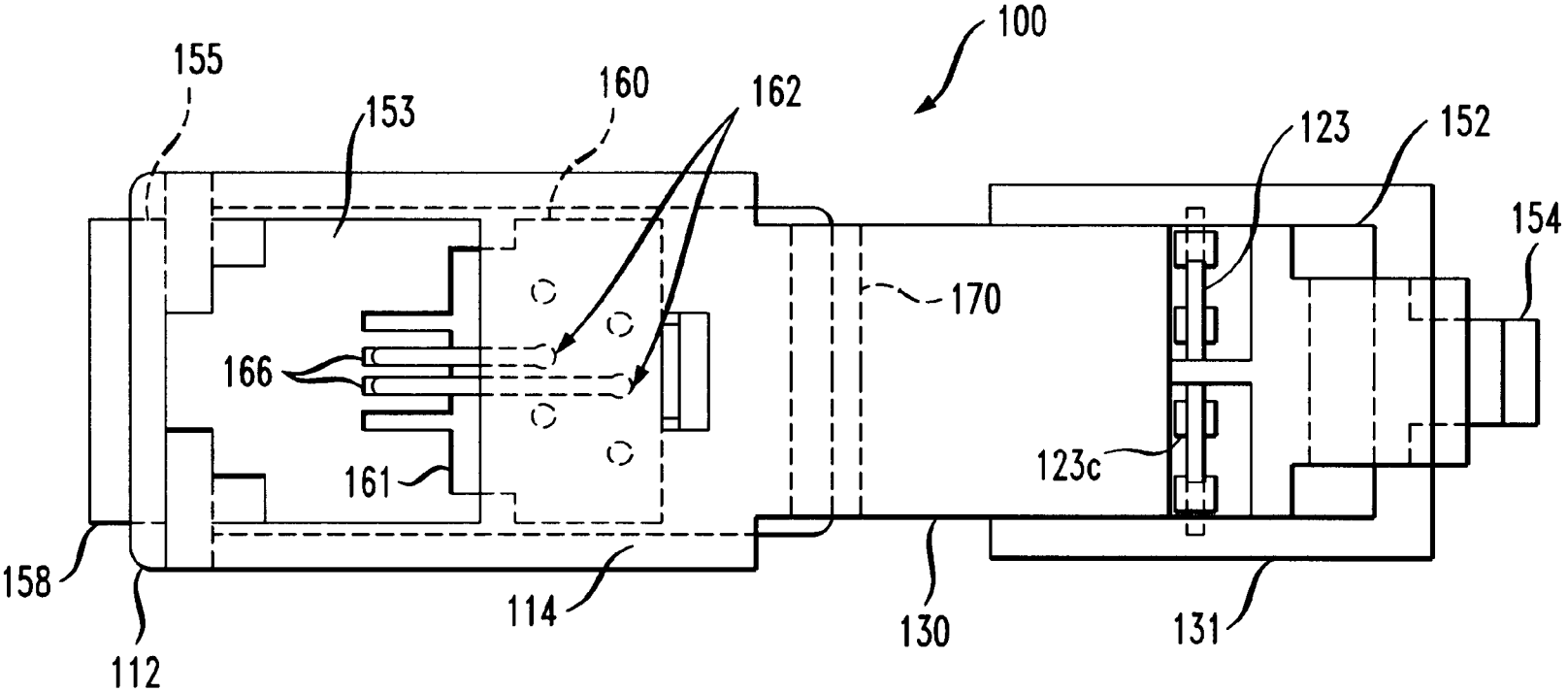
FIG. 1D is a plan view of the device of FIG. 1C.
Figure 1G:
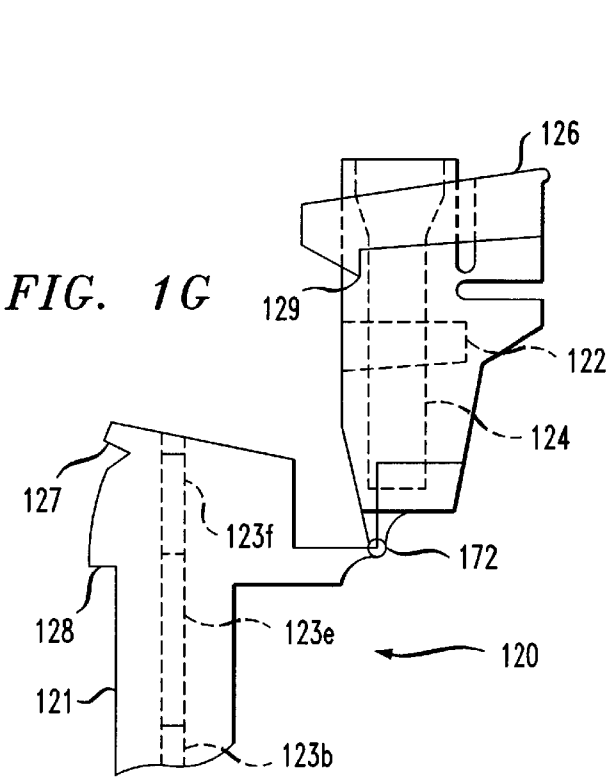
FIGS. 1E–1G are rear elevation views showing the top portion of the device of FIG. 1A, in three different positions.
Figure 1F:
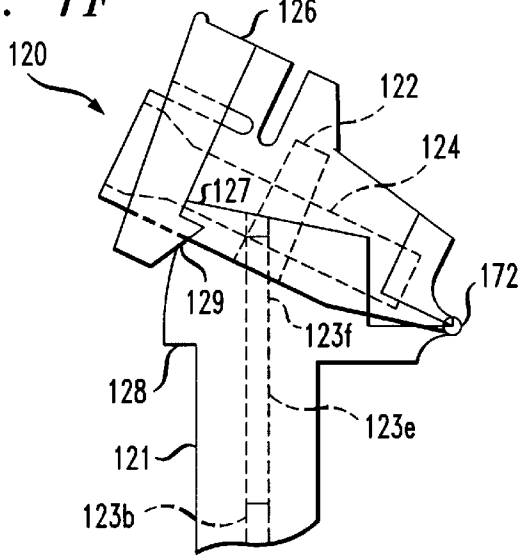
Figure 1E:
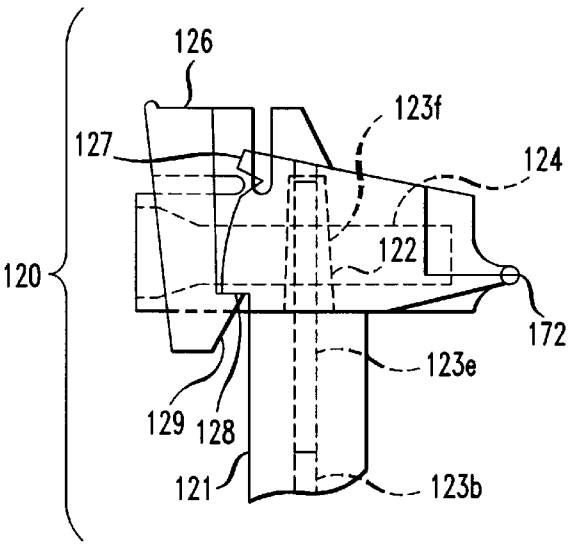

In the exemplary embodiment, there is sufficient separation in the (X) direction so that no separation in the (Y) direction is necessary to provide the desired total separation (and thereby limit the parasitic couplings). Thus, as shown in FIG. 1A, the first and second terminals 123 are positioned in a single (Y=constant) plane.

Because no separation in the (Y) direction is required, the depth of the connector 120 in the (Y) direction can be reduced below that of known connectors in the prior art. Because of the reduced depth in the (Y) direction, the total weight of the material required may be reduced.

Figure 1H:
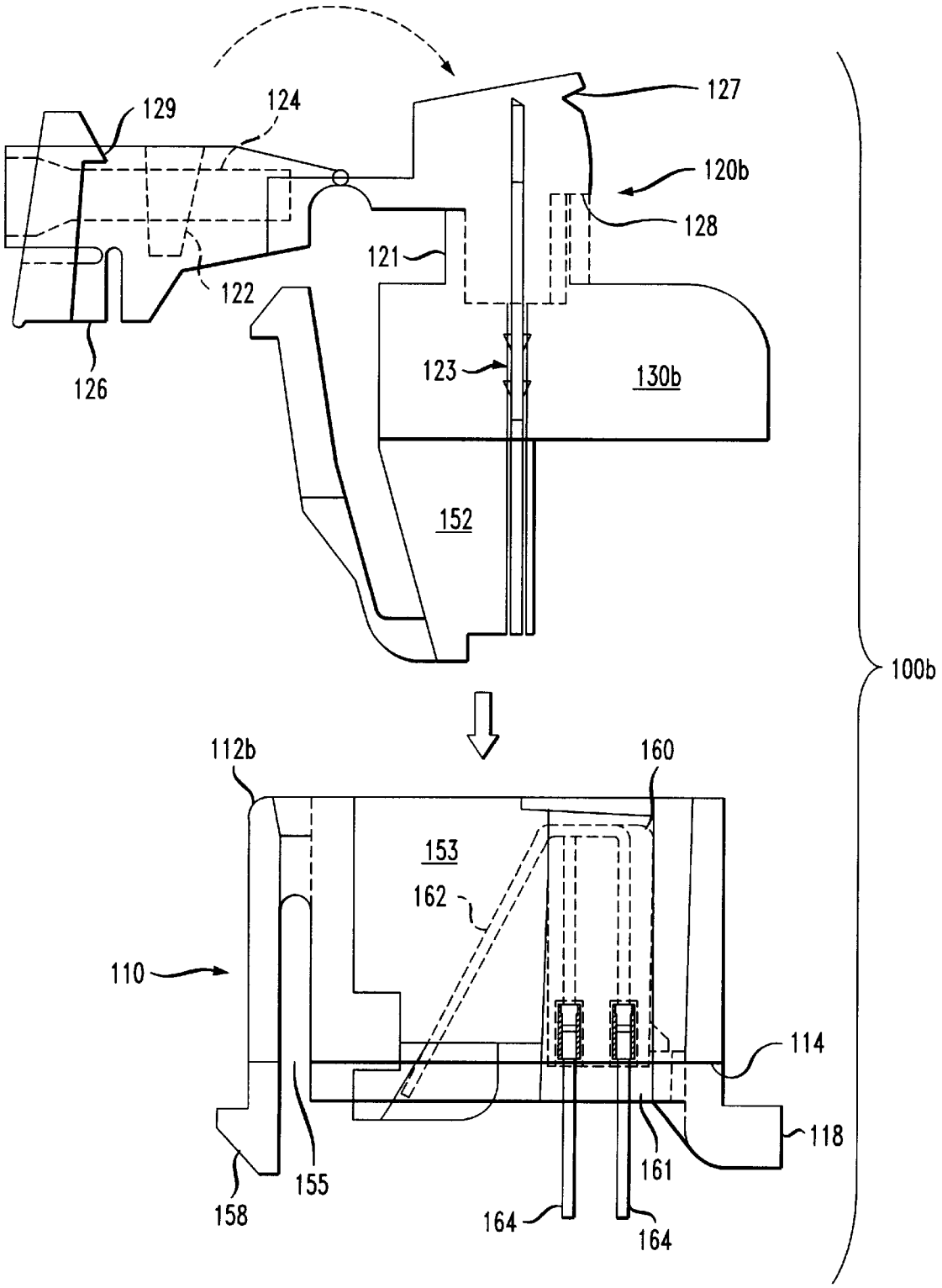
FIG. 1H is a front elevation view of a variation of the device of FIG. 1A.

FIG. 1H shows a two piece bridge assembly 100*b*. One of ordinary skill recognizes that a device similar to the exemplary embodiment may be constructed, in which the base 112*b* and the middle portion 130*b* are separate pieces, and are not connected by hinge 170; middle section 130*b*, 121 and upper section 126 may still be integrally formed from a single piece of material, and are still connected by living hinge 172. In this configuration, the cap 126 and the body (which includes portions 152, 130*b* and 121) form an IDC connector 120*b* which can plug into the RJ11 jack 153 of base 112, or can be inserted into any standard RJ11 jack.

Alternatively, the cap 126 of connector 120 may be a separate piece, and need not be connected by a hinge 172. The three sections (base 112, middle section 130 and 121, and upper section 126) may all be separate sections. In some instances, forming assembly 100 in two or three separate pieces may simplify the molding of the parts, but it does increase the possibility that one or more of the parts may become separated or lost during handling, installation or maintenance.

Alternatively, the three sections (base 112, middle section 130 and 121, and upper section 126) may be formed separately, and may be joined using a pivot or hinge joint, other than a living hinge. Once the hinges are assembled, the assembly may function substantially as described for the embodiment of FIG. 1A. However, if the pivot or hinge joint is not secure, then the sections of the assembly would be more likely to become separated or lost.

Figure 2B:
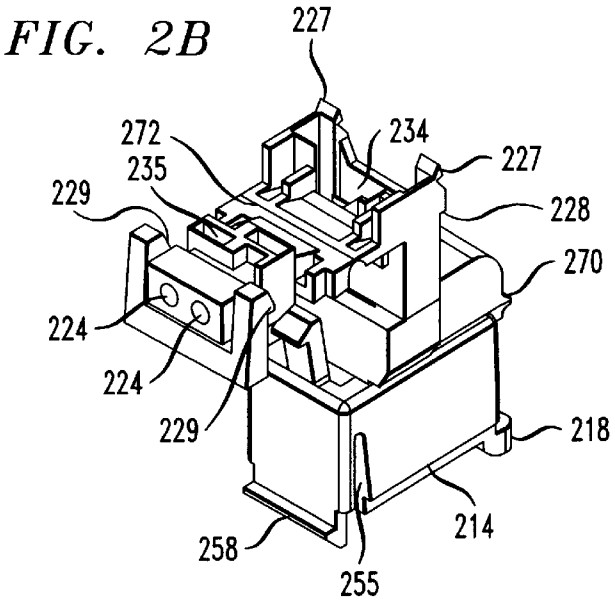
FIGS. 2A–2C are isometric views of another variation of the device of FIG. 1A, in three different positions.
Figure 2C:
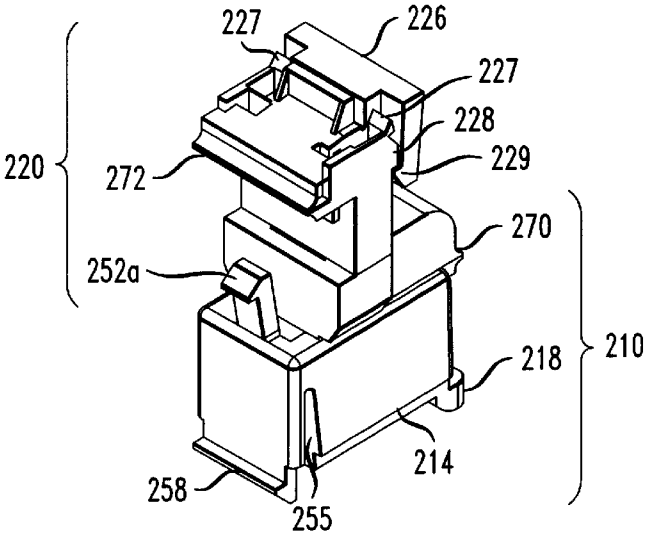
Figure 2A:
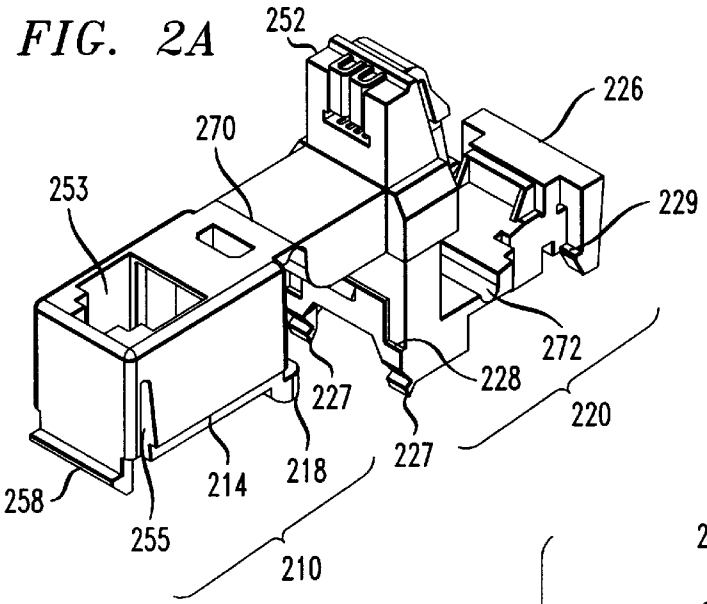
Figure 2D:
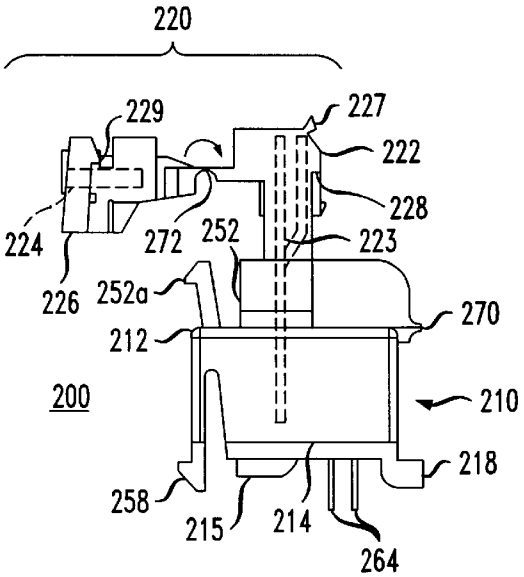
FIG. 2D is a front elevation view of the variation of FIG. 2A.

FIGS. 2A through 2C are isometric views showing a variation of the exemplary embodiment, and FIG. 2D is a front elevation view of the variation of FIG. 2A. Features in FIGS. 2A–2D which are similar to features shown in FIGS. 1A–1G are indicated by reference numerals which differ by 100. Only the features which differ between the two variations are described below, for the purpose of brevity.

The external network interface 210 is substantially identical to the external network interface 110, and a description thereof is not repeated.

Customer interface 220 is similar to an RBC2100 mini-rocker connector manufactured by the Egerton Company of Cheshire, England, except that the base of connector 220 is integrally attached to RJ11 plug 252, and extended length terminals 223 reach down to form an electrical connection with the conductors of RJ11 plug 252.

Each of the terminals 223 includes a top portion having upwardly extending tangs for receiving the customer lead wires. The top portions of the terminals 223 are not in the same plane as each other, as best seen in FIG. 2D. At least one of the terminals has an offset between the top portion of the terminal and the bottom portion of the terminal. The bottoms of the terminals 223 are aligned so as to fit into the RJ11 type plug portion 252. Connector 220 has a top portion 226 which includes two lead wire holes 224. Cap 226 has two latches 229 which may be engaged by either of projections 228 or 227. The holes 224 are positioned between the two latches 229.

Other IDC output connector mechanisms may also be used.

Figure 3:
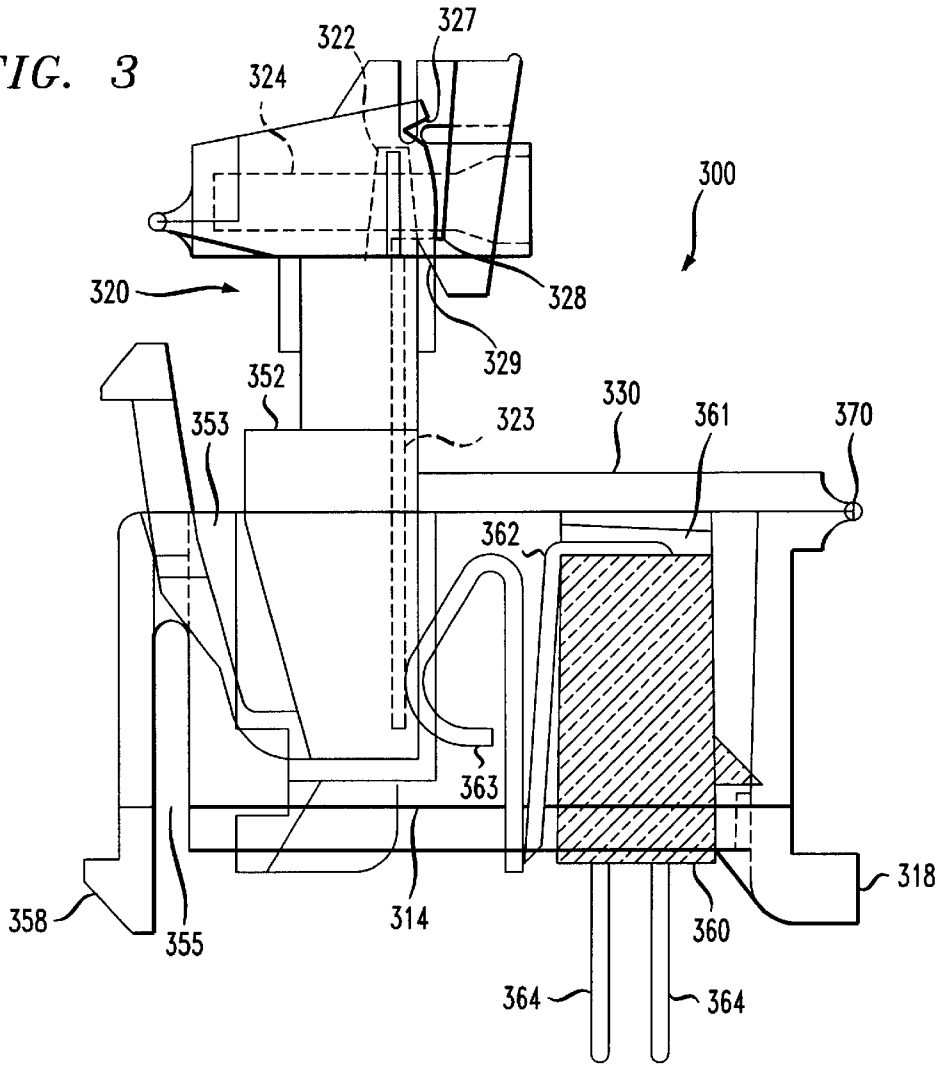
FIG. 3 is a front elevation view of a further variation of the device of FIG. 1A.

FIG. 3 shows another variation of the exemplary embodiment. Features in FIG. 3 which are similar to features shown in FIGS. 1A–1G are indicated by reference numerals which differ by 200. Only the features which differ between the two variations are described below, for the purpose of brevity. The customer output connector 320 is substantially identical to the connector 120, and a description thereof is not repeated.

In the bridge assembly 300 of FIG. 3, the lower portions of the first and second terminals 323 are connected to the first jack 361 by a pair of conductors 363. Thus, the conductors 362 of the type-645 plug need not directly contact the terminals 323. The electrical effect is the same, regardless of whether the jacks 153 and 161 are connected and conductors 162 contact the terminals (as in FIG. 1A), or an intermediate conductor bridges the two jacks 153 and 161 (as in FIG. 3).

FIG. 3 shows a further advantageous feature of the invention. Instead of connecting the type-645 connector to wires 164 (as in FIG. 1A), the type-645 plug 360 may have printed circuit board (PCB) terminals. The assembly 300 may be mounted directly on a PCB (not shown).

Alternatively, the assembly 300 may be mounted to a sheet metal panel with a PCB behind the panel. The electrical connections to the external network are still made via the PCB. Because the bearing surface 314 limits how far base 112 can be inserted into the opening in the panel, this configuration prevents the installer from applying excess force on the PCB. This may avoid damage to the circuit elements on the PCB.

Although the invention has been described in terms of exemplary embodiments, it is not limited thereto. Rather, the appended claim should be construed broadly, to include other variants and embodiments of the invention which may be made by those skilled in the art without departing from the scope and range of equivalents of the invention.

What is claimed is:

1. A network interface device, comprising:

a base having a first jack and a second jack proximate to the first jack;

a body having a plug portion shaped to fit into the second jack, the plug portion having first and second terminals, each terminal having an upper portion and a lower portion, the lower portions of the first and second terminals being connected to the first jack; and a cap which receives the upper portions of the first and second terminals, the cap including first and second holes, the cap having an open position a first wire and a second wire being insertable into the first and second holes, respectively, when the cap is in the open position, the cap having a closed position, the upper portions of the first and second terminals being connectable to the respective first and second wires when the cap is in the closed position.

2. A device according to claim 1, wherein the body is pivotally attached to the base.

3. A device according to claim 1, further comprising a living hinge pivotally attaching the body to the base.

4. A device according to claim 1, wherein the cap is pivotally attached to the body.

5. A device according to claim 1, further comprising a living hinge pivotally attaching the cap to the body.

6. A device according to claim 1, wherein the base, body and cap are integrally formed by a single piece of an insulating material.

7. A device according to claim 1, wherein the upper portion of each terminal includes a plurality of upwardly projecting members which displace sufficient insulation from the first and second wires to form electrical connections between the first and second terminals and the first and second wires, respectively, when the cap is in the closed position.

8. A device according to claim 1, wherein the lower portions of the first and second terminals are connected to the first jack by one of the group consisting of a pair of conductors and at least one opening in the base between the first and second jacks.

9. A device according to claim 1, wherein the lower portions of the first and second terminals are connected to the first jack by a pair of openings in the base between the first and second jacks, each of the openings capable of receiving a conducting portion of an external plug when the external plug is inserted in the first jack, so that the conducting portions of the external plug contact the lower portions of the first and second terminals.

10. A device according to claim 1, wherein the lower portions of the first and second terminals are connected to the first jack by a pair of conductors in the base between the first and second jacks, each of the conductors capable of contacting a conducting portion of an external plug when the external plug is inserted in the first jack.

11. A device according to claim 1, wherein the cap has a single latch, positioned between the first and second holes, for maintaining the cap in the closed position.

12. A device according to claim 1, wherein the cap has a pair of latches for maintaining the cap in the closed position, the first and second holes being positioned between the pair of latches.

13. A device according to claim 1, wherein the device has a footprint, the first jack has a footprint, and the second jack has a footprint; and when the plug portion is inserted in the second jack, and the cap is in the closed position, the footprint of the device is approximately the sum of the footprints of the first jack and the second jack.

14. A device according to claim 13, wherein the first jack is on a bottom of the base and the second jack is on a top of the base.

15. A device according to claim 1, wherein each terminal includes means for gripping an interior surface of the body.

16. A network interface device, comprising:

a base having a first jack on a bottom thereof and a second jack on a top thereof;

a body pivotally attached to the base, the body having a plug portion shaped to fit into the second jack, the plug portion having first and second terminals, each terminal having an upper portion and a lower portion, the lower portions of the first and second terminals being connected to the first jack by a pair of openings in the base between the first and second jacks, each of the openings capable of receiving a conducting portion of an external plug when the external plug is inserted in the first jack, so that the conducting portions of the external plug contact the lower portions of the first and second terminals, and a cap pivotally attached to the body, the cap receiving the upper portions of the first and second terminals, the cap including first and second holes, the cap having an open position, a first wire and a second wires being inserted into the first and second holes, respectively, when the cap is in the open position, the cap having a closed position, the upper portions of the first and second terminals being connectable to the respective first and second wires when the cap is in the closed position.

17. A device according to claim 16, wherein the base, body and cap are integrally formed by a single piece of an insulating material.

18. A device according to claim 16, wherein the device has a footprint, the first jack has a footprint, and the second jack has a footprint; and when the plug portion is inserted in the second jack, and the cap is in the closed position, the footprint of the device is approximately the sum of the footprints of the first jack and the second jack.

19. A device according to claim 16, wherein the cap has a single latch, positioned between the first and second holes, for maintaining the cap in the closed position.

20. A connector comprising:

a body having a plug portion shaped to fit into a telephone jack;

first and second terminals extending through the plug portion, each terminal having an upper portion and a lower portion, the lower portions of the first and second terminals being connected to a telephone network when the plug portion is inserted in the telephone jack; and a cap pivotally attached to the body, the cap receiving the upper portions of the first and second terminals, the cap including first and second holes, the cap having an open position, a first wire and a second wire being insertable into the first and second holes, respectively, when the cap is in the open position, the cap having a closed position, the upper portions of the first and second terminals being connectable to the respective first and second wires when the cap is in the closed position.

21. The connector of claim 20, wherein the cap is attached to the body by a living hinge.

22. The connector of claim 20, wherein the cap has a single latch, positioned between the first and second holes, for maintaining the cap in the open position or the closed position.

23. The connector of claim 20, wherein the cap includes fastening means, positioned only between the first and second holes, for maintaining the cap in the open position or the closed position.

* * * * *